US006830299B2

(12) United States Patent
Henriott et al.

(10) Patent No.: US 6,830,299 B2
(45) Date of Patent: Dec. 14, 2004

(54) ARTICLE OF FURNITURE HAVING HIDDEN SLIDE

(75) Inventors: Jay M. Henriott, Jasper, IN (US); Kevin T. Rauscher, Celestine, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 10/160,794

(22) Filed: May 31, 2002

(65) Prior Publication Data

US 2003/0222543 A1 Dec. 4, 2003

(51) Int. Cl.[7] ..... A47F 3/00
(52) U.S. Cl. ..... 312/139.2; 312/350
(58) Field of Search ..... 312/198, 199, 312/109, 139.2, 330.1, 350; 49/63, 207, 404, 425, 426; 434/430, 429

(56) References Cited

U.S. PATENT DOCUMENTS

| | | | | |
|---|---|---|---|---|
| 794,524 A | | 7/1905 | Lobel | |
| 2,485,296 A | | 10/1949 | Lescaze | |
| 3,166,801 A | | 1/1965 | Provenzo | |
| 3,521,382 A | * | 7/1970 | Chauvin | 434/108 |
| 4,281,435 A | | 8/1981 | Winter et al. | |
| 5,675,946 A | | 10/1997 | Verbeek et al. | |
| 5,873,205 A | | 2/1999 | Hanlon et al. | |
| 5,941,713 A | * | 8/1999 | Wayner et al. | 434/414 |
| 5,992,956 A | | 11/1999 | Slivon | |
| 6,152,549 A | | 11/2000 | Goto et al. | |

FOREIGN PATENT DOCUMENTS

| | | | |
|---|---|---|---|
| JP | 407104690 A | * | 4/1995 |
| JP | 411038908 A | * | 2/1999 |

OTHER PUBLICATIONS

Hafele Product Brochure—Slidematic Door Closer for Sliding Doors.
Parts Brochure, Ezy–Roll Alumninum Track; Ball Bearing Track; Plastic Track & Glides for Sliding Doors; Track & Upper Guide; Rollers; Enclosed Sheaves; Sheaves.

* cited by examiner

*Primary Examiner*—Hanh V. Tran
(74) *Attorney, Agent, or Firm*—Baker & Daniels

(57) ABSTRACT

A mounting arrangement for mounting a door or other element to an article of furniture using an existing slide mechanism of the type known for use in drawers, wherein the slide mechanism is hidden from view when the door or other element is in both a closed and in an open position to enhance the aesthetic design of the article of furniture. The slide mechanism is mounted to a rear or interior surface of the article of furniture, and a bracket connects the slide mechanism to a door or other element which is disposed adjacent a front face of the article of furniture. In this manner, the slide mechanism and bracket are hidden from view regardless of the position of the door or other element. In one embodiment, a cabinet with a door connected thereto by hidden slides is provided, and in another embodiment, a display board with covers connected thereto by hidden slides is provided.

12 Claims, 6 Drawing Sheets

ARTICLE OF FURNITURE HAVING HIDDEN SLIDE

BACKGROUND OF THE INVENTION

1. Field of the Invention

The present invention relates to furniture components having doors or other elements which are mounted to the furniture components by slide mechanisms.

2. Description of the Related Art

Slide mechanisms are typically used in furniture components to mount doors and drawers, for example, to furniture components such that the doors and drawers are movable between open and closed positions. Such slide mechanisms are well known and readily available, and typically include two-part slides having inner and outer slide members connected by a ball bearing arrangement such that the inner slide member is telescopingly slidable outwardly of the outer slide member. Additionally, such slide mechanisms also include three part slides having an intermediate slide member disposed between the inner and outer slide members, with the intermediate slide member telescopingly slidable outwardly of the outer slide member, and the inner slide member in turn telescopingly slidable outwardly of the intermediate slide member.

In drawers, the slide mechanisms are mounted between the drawer side walls and the interior surfaces of a cabinet, such that when the drawer is pulled outwardly of the cabinet, the slide mechanism is visible. Similarly, in doors, such slide mechanisms are mounted between the rear surface of the door and the exterior of a cabinet, such that when the door is opened by sliding same laterally, the slide mechanism is visible. The visibility of the slide mechanism when the door is open detracts from the aesthetic design of the article of furniture, and it is therefore undesirable.

Known mechanisms have been developed for mounting a door to a cabinet which include multiple brackets and/or roller assemblies used in conjunction with slide mechanisms to slidably mount the door to the cabinet, wherein such mechanisms are partially or substantially hidden from view. However, such prior systems tend to involve multiple components, and are often expensive, as well as difficult to install. Further, such systems typically take up a relatively large amount of space between the door and the cabinet, limiting design flexibility.

What is needed is a mounting arrangement for articles of furniture having openable doors or other elements, in which an inexpensive slide mechanism may be used to slidably mount the doors or other elements to the article of furniture, and wherein the slide mechanism is hidden from view when the door or other element is opened.

SUMMARY OF THE INVENTION

The present invention provides a mounting arrangement for mounting a door or other element to an article of furniture using an existing slide mechanism of the type known for use in drawers, wherein the slide mechanism is hidden from view when the door or other element is in either a closed or an open position to enhance the aesthetic design of the article of furniture. The slide mechanism is mounted to a rear or interior surface of the article of furniture, and a bracket connects the slide mechanism to a door or other element which is disposed adjacent a front face of the article of furniture. In this manner, the slide mechanism and bracket are hidden from view regardless of the position of the door or other element. In one embodiment, a cabinet with a door connected thereto by hidden slides is provided, and in another embodiment, a display board with covers connected thereto by hidden slides is provided.

In one embodiment, a cabinet includes a front face having at least one panel, the panel having a rear surface facing the interior of the cabinet to which a slide mechanism is attached such that the slide mechanism is hidden from view. A door is mounted adjacent the front face of the article of furniture by a bracket which connects the door to the slide mechanism. In a closed position, the slide mechanism and bracket are hidden from view by the door itself. The slide mechanism is disposed substantially horizontally, such that the door is slidable laterally relative to the cabinet to an open position, wherein in such an open position, the extended slide mechanism and bracket are hidden from view by the front panel of the cabinet and by the opened door. The side wall of the cabinet may include a cutout portion for accommodating extension of the slide mechanism therethrough when the door is opened.

Additionally, the cabinet may include a rear wall having a pair of side walls extending therefrom, with one side wall extending from the rear wall to a greater extent than the other side wall, such that the front face is non parallel to the rear wall. Thus, when a plurality of cabinets are arranged adjacent to one another, the door of one cabinet may be opened by sliding same laterally to overlap the door of an adjacent cabinet. In this manner, a plurality of cabinets may be disposed in a row adjacent to one another, each cabinet having a door which is opened by sliding same laterally.

In another embodiment, a display board is provided having a main panel with a front surface which may include a marker board, chalk board, or other functional surface, for example, and a rear surface which may include mounting structure for mounting the display board to a wall. A slide mechanism is mounted to the rear surface of the main panel, and thus is hidden from view. At least one bracket is used to connect the slide mechanism to a cover which is disposed adjacent the front face of the main panel. In this manner, the cover may slide laterally outwardly with respect to the main panel to selectively expose or cover the main panel. The display board may include two such cover panels which are slidable laterally outwardly of the main panel in opposite directions to expose the main panel for use or to cover the main panel.

In one form thereof, the present invention provides an article of furniture, including a furniture body including a first panel having a front surface and a rear surface; a slide mechanism including at least an inner slide member and an outer slide member which are slidable relative to one another, one of the inner and outer slide members attached directly to the rear surface of the first panel; a bracket having a first portion and a second portion, the first portion attached to the other of the inner and outer slide members; and a second panel attached to the second portion of the bracket, the second panel disposed adjacent the front surface of the first panel; whereby the second panel is slidable relative to the first panel and the slide mechanism is hidden from view behind the first panel.

In another form thereof, the present invention provides a cabinet, including a cabinet body defining an interior space; a panel attached to the cabinet body, the panel including an interior surface exposed to the interior space, and an exterior surface opposite the interior surface; a slide mechanism mounted to the interior surface of the panel and disposed within the interior space; a door disposed adjacent the exterior surface of the panel; and a bracket connecting the slide mechanism and the door, wherein the door is slidable relative to the cabinet body to open and close the interior space.

In another form thereof, the present invention provides a cabinet, including a cabinet body including a rear wall, a pair of side walls extending from the rear wall, and a front face opposite the rear wall, one of the side walls extending further from the rear wall than the other side wall such that the front face is non-parallel to the rear wall; and a door mounted to the cabinet body and disposed non-parallel to the rear wall, the door moveable between a closed position in which the door covers the front face and an open position in which the door is disposed laterally of the front face.

In a further form thereof, the present invention provides a display board, including a first panel having a rear surface and a front surface; a slide mechanism connected to the rear surface of the panel; a second panel disposed adjacent the front surface of the first panel; and a bracket connecting the slide mechanism and the second panel, wherein the second panel is slidable relative to the first panel to selectively cover and expose the front surface of the first panel.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION

Figure 1:
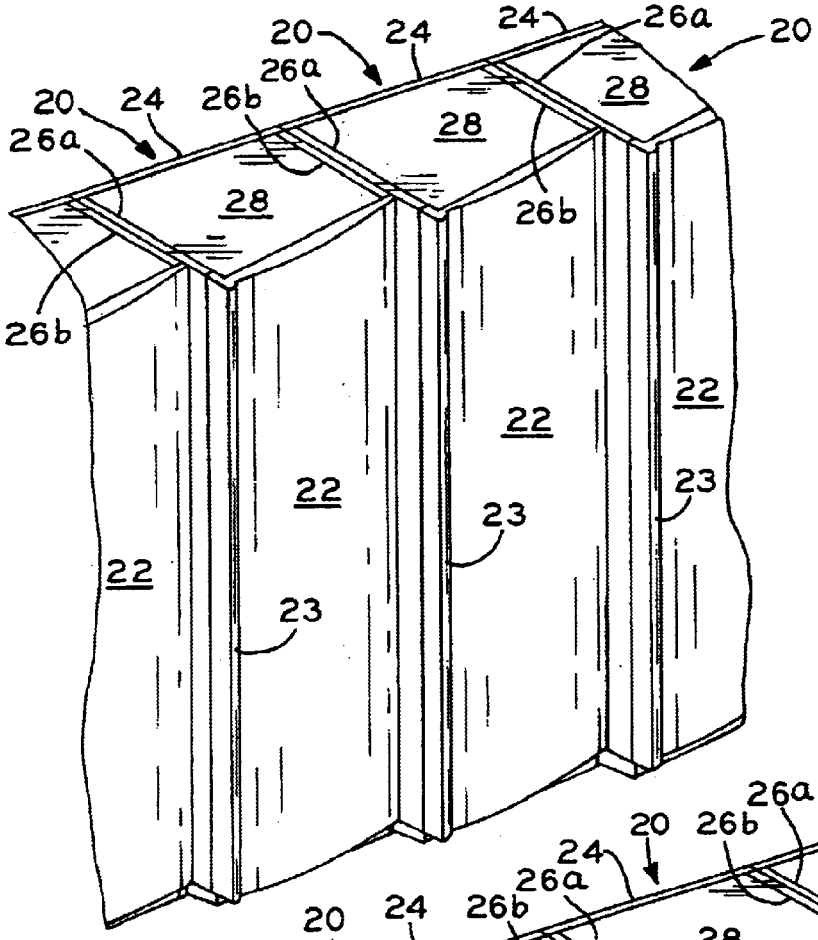
FIG. 1 is a partial perspective view of a plurality of cabinets disposed in a row adjacent to one another, according to the present invention.
Figure 3:
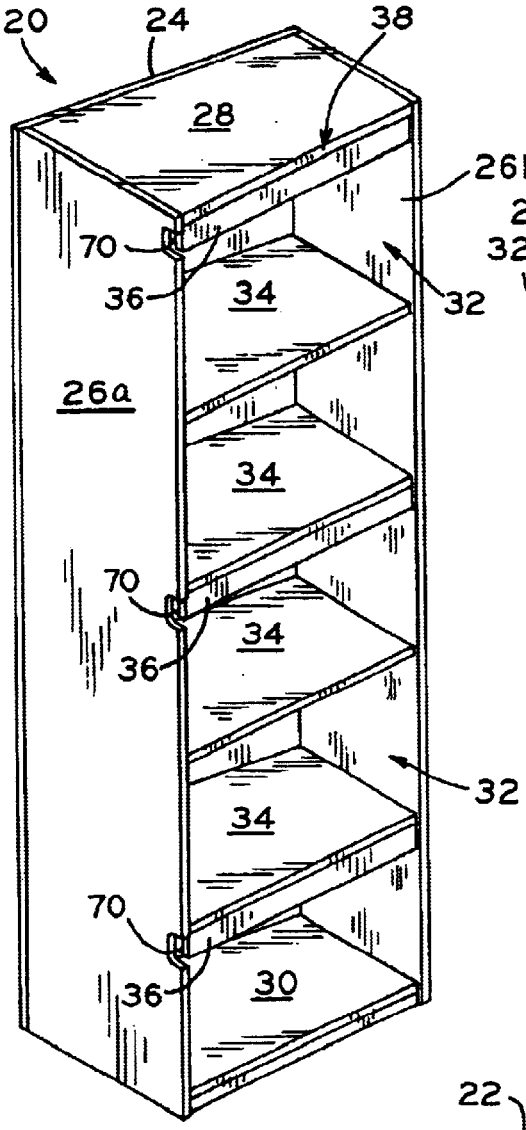
FIG. 3 is a perspective view of one of the cabinets of FIGS. 1 and 2, wherein the door has been omitted to show the interior of the cabinet.

Referring to FIG. 1, a plurality of cabinets 20 are shown disposed in a row adjacent to one another, each cabinet 20 having a door 22 which is slidable laterally outwardly of the cabinet to open the cabinet, as explained in further detail below. Referring to FIG. 3, each cabinet includes rear wall 24, side wall 26*a*, side wall 26*b*, top wall 28, and a bottom wall or shelf 30, together defining interior space 32 within cabinet 20. Shelves 34 are mounted within interior space 32 to divide same into multiple smaller spaces for storage. Attached to top wall 28 and to some of the shelves 34 are slide mounting panels 36.

Figure 2:
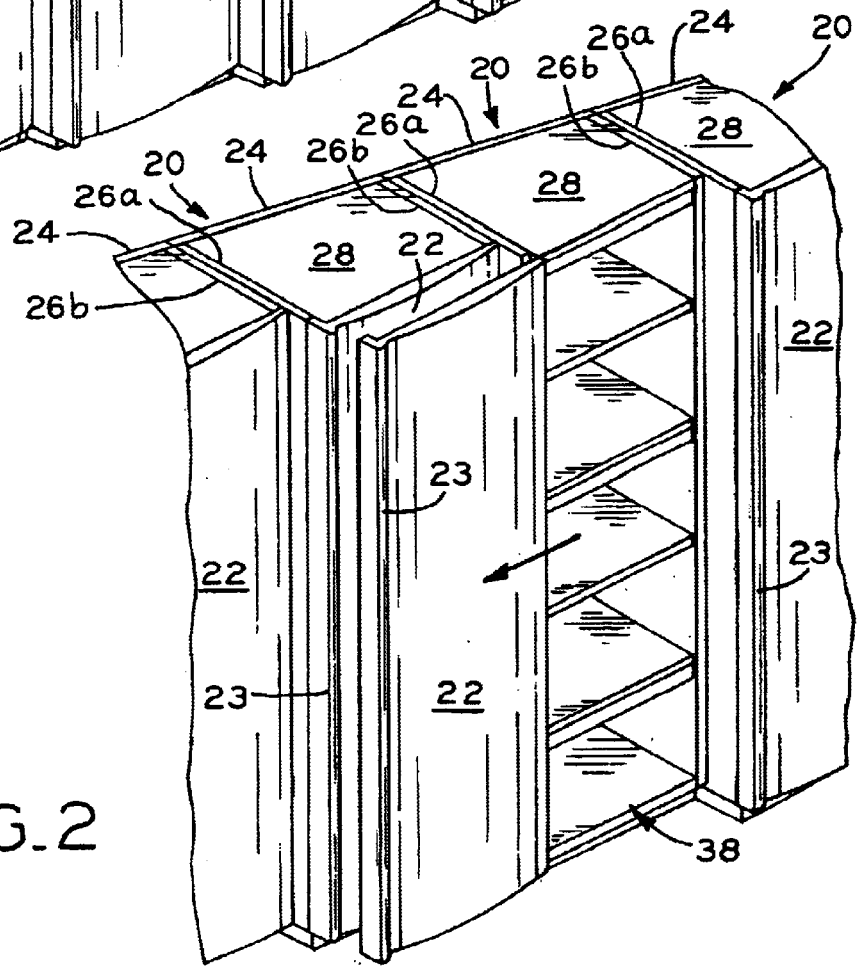
FIG. 2 is a partial perspective view of the plurality of cabinets of FIG. 1, showing the door of one cabinet in an open position.

Referring to FIGS. 1–3, it may be seen that side wall 26*a* is deeper than side wall 26*b*, wherein side wall 26*a* extends from rear wall 24 to a greater extent than side wall 26*b*. In this manner, side walls 26*a* and 26*b* define front face 38 of cabinet 22 which is non-parallel to rear wall 24, such that cabinet 22 has a trapezoidal shape. Referring to FIG. 1, it may be seen that door 24, mounted adjacent front face 38 as described below, is also disposed non-parallel to rear wall 24.

Figure 5:
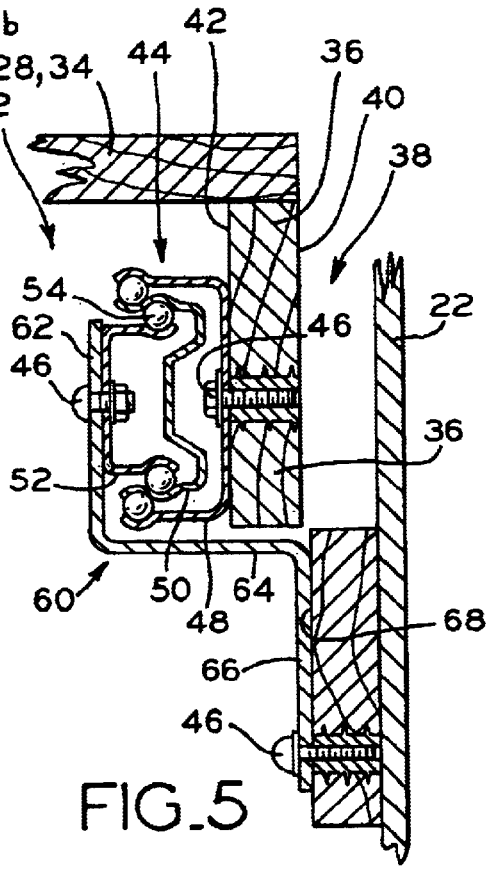
FIG. 5 is a sectional view taken along line 5—5 of FIG. 4.
Figure 4:
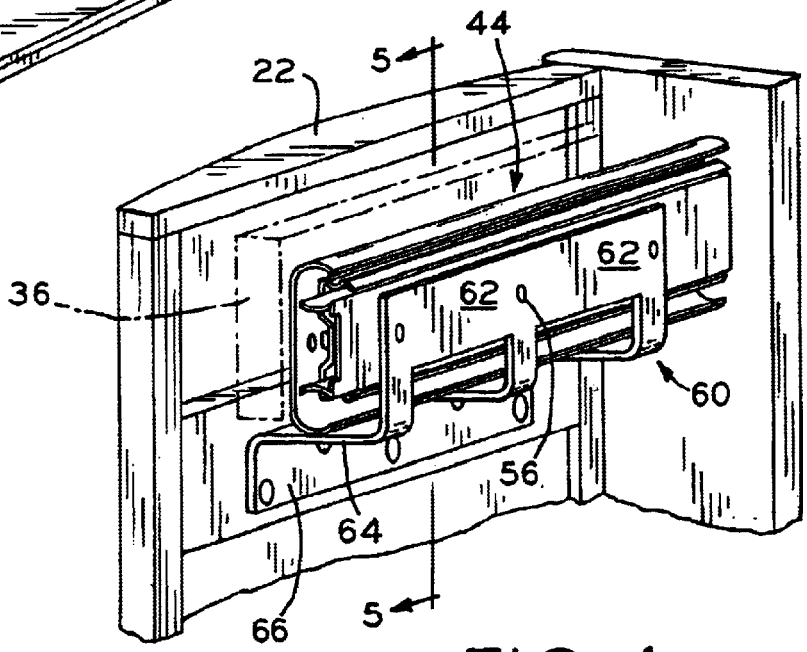
FIG. 4 is a partial perspective view from the interior of a cabinet, looking outwardly, showing the slide mechanism attached to a front panel of the cabinet, the front panel shown in ghost lines, and a bracket connecting the slide mechanism to the door.

Referring to FIGS. 4 and 5, each mounting panel 36 includes front surface 40 and rear surface 42, with front surface 40 facing front face 38 of cabinet 22, and rear surface 42 facing interior space 32 of cabinet 22. Referring to FIG. 5, slide mechanism 44 is mounted to rear surface 42 of mounting panel 36 by suitable fasteners 46. Slide mechanism 44 is a known, readily available telescoping slide mechanism of the type often used for mounting drawers within cabinets, and generally includes outer slide member 48, intermediate slide member 50, and inner slide member 52, with the foregoing slidably connected to one another by ball bearing assemblies including a plurality of balls 54, as is known. Alternatively, slide mechanism 44 may include only outer slide member 48 and inner slide member 52. Thus, because slide mechanism 44 is an existing, readily available component, the costs associated with assembling cabinet 20 may be reduced.

Outer, intermediate, and inner slide members 48, 50, and 52 are telescopingly slidable with respect to one another, such that intermediate slide member 50 is telescopingly slidable outwardly of outer slide member 48, and inner slide member 52 is in turn telescopingly slidable outwardly of intermediate slide member 50. As shown in FIG. 5, slide mechanism 44 is mounted directly to rear surface 42 of mounting panel 36 by fasteners 46, which extend through apertures 56 (FIG. 4) in outer slide member 48.

As shown in FIGS. 4 and 5, a substantially Z-shaped bracket 60 includes first portion 62 connected to inner slide member 52 by suitable fasteners 46, intermediate portion 64, and second portion 66 connected to the interior surface 68 of door 22 by suitable fasteners 46. Bracket 60 may comprise a single piece of bent metal, for example. In this manner, door 22 is connected to slide mechanism 44 by bracket 60, such that door 22 may slide laterally outwardly with respect to mounting panel 36 and cabinet 20.

Referring to FIG. 1, doors 22 of cabinets 20 are shown in closed positions, and referring to FIG. 2, one door 22 of a cabinet 20 is shown in an open position. Regardless of whether door 22 is in the opened or closed position, slide mechanism 44 remains hidden behind mounting panel 36 of cabinet 20 or behind door 22, and bracket 60 remains hidden behind door 22, such that neither slide mechanism 44 nor bracket 60 is visible when door 22 is in a closed or open position. Therefore, the aesthetic, visual design of cabinet 20 is enhanced, as the hardware associated with mounting door 22 to cabinet 20 is always hidden regardless of whether door 22 is in a closed or open position. As shown in FIG. 3, side wall 26*a* includes cutout portions 70 adjacent mounting panels 36 to accommodate extension of slide mechanisms 44 therethrough when door 22 is opened. Thus, slide mechanisms 44 may be located within interior space 32 of cabinet 20 rather than outside of cabinet 20. Further, as shown in FIGS. 1 and 2, doors 22 may each include handle portion 23 which may be grasped to aid in opening doors 22.

Referring to FIGS. 1 and 2, it may be seen that due to the non-parallel arrangement of front face 38 and door 22 of each cabinet 20 with rear wall 24 thereof, the door 22 of one cabinet 20 may be opened by sliding same laterally outwardly of the cabinet 20 such that same overlaps the door 22 of an adjacent cabinet 20. Otherwise, if door 22 were disposed parallel to rear wall 24 of cabinet 20, sliding, lateral movement of door 22 would not be possible if cabinet 20 were disposed in a row of identical such cabinets as shown in FIGS. 1 and 2.

Referring to FIGS. 6–9, display board 80 is shown, according to a second embodiment of the present invention. Display board 80 generally includes main panel 82 and a pair of covers 84 mounted thereto, as explained in further detail below.

Figure 6:
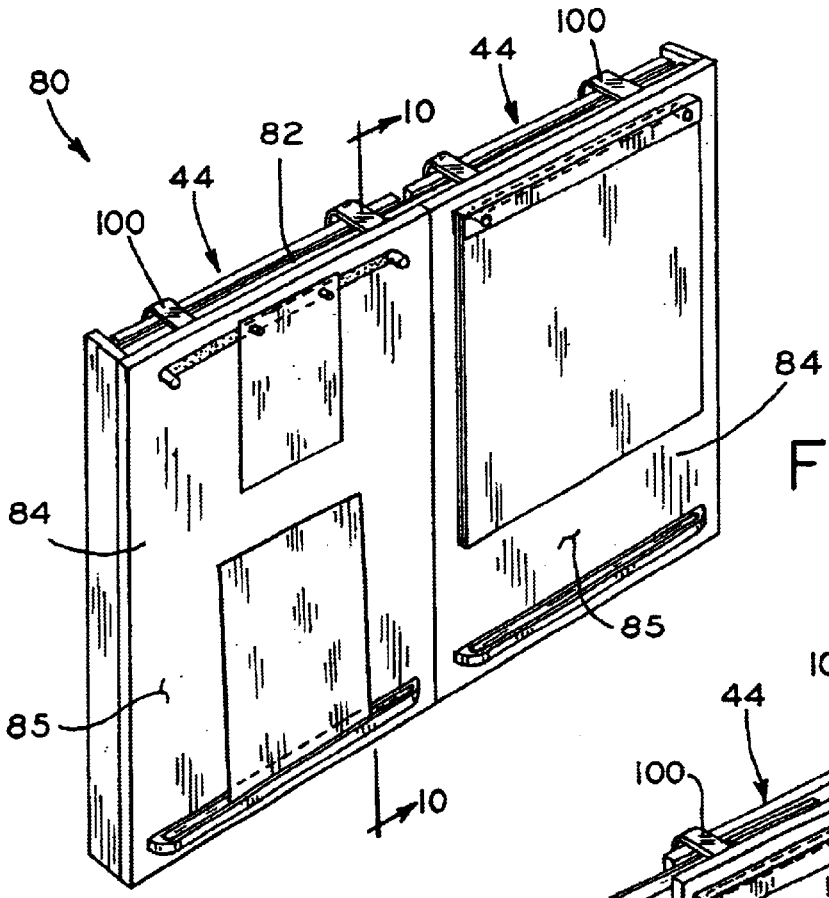
FIG. 6 is a front perspective view of a display board according to another embodiment of the present invention, the covers of the display board shown in a closed position.
Figure 7:
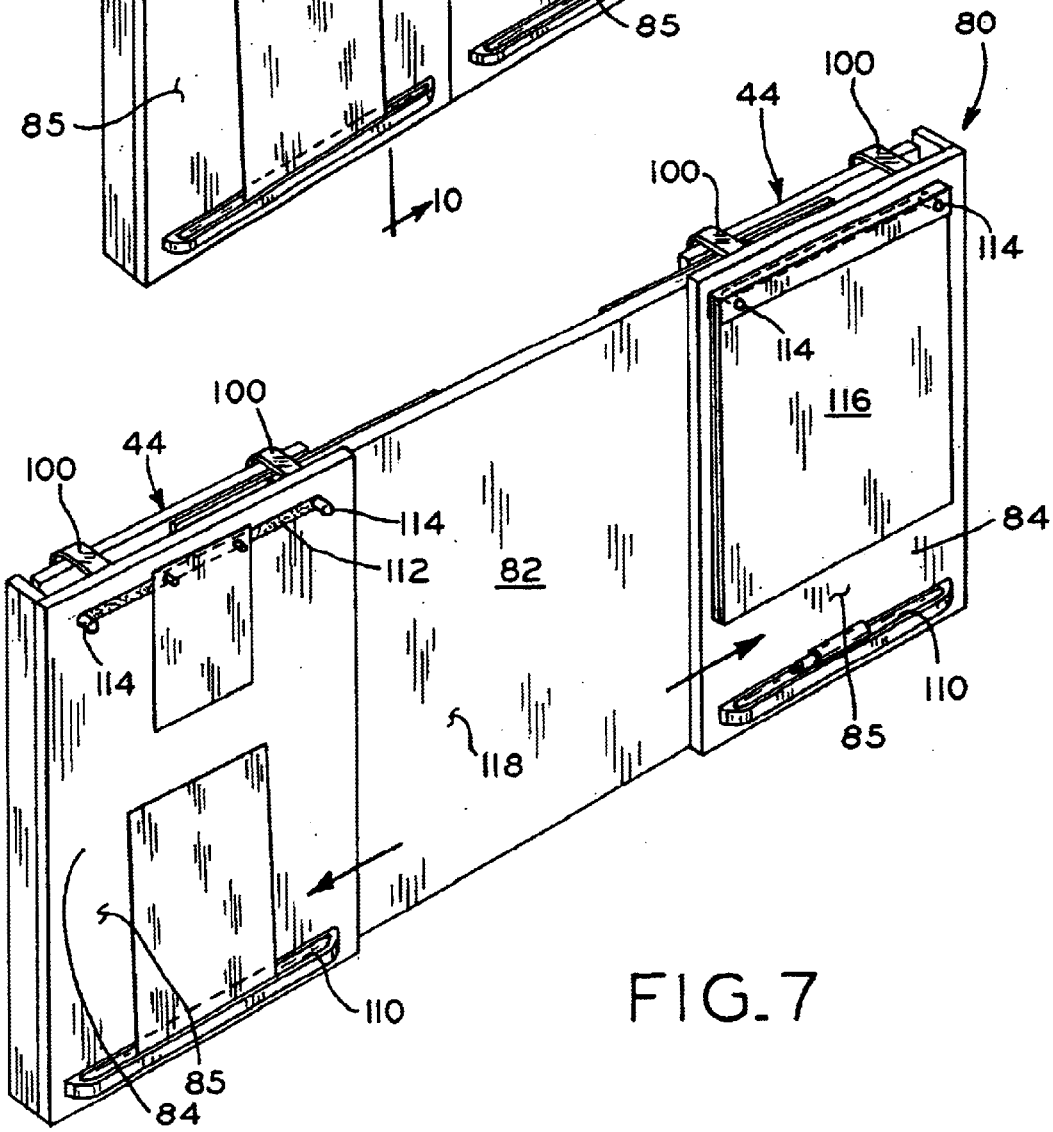
FIG. 7 is a front perspective view of the display board of FIG. 6, showing the covers in an open position.
Figure 8:
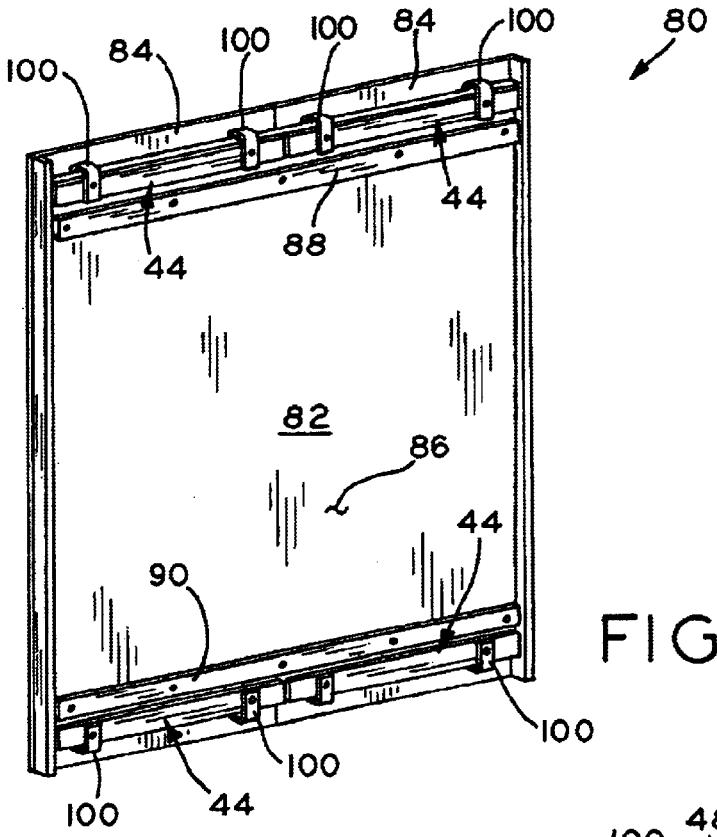
FIG. 8 is a rear perspective view of the display board of FIG. 6, showing the covers in a closed position.
Figure 9:
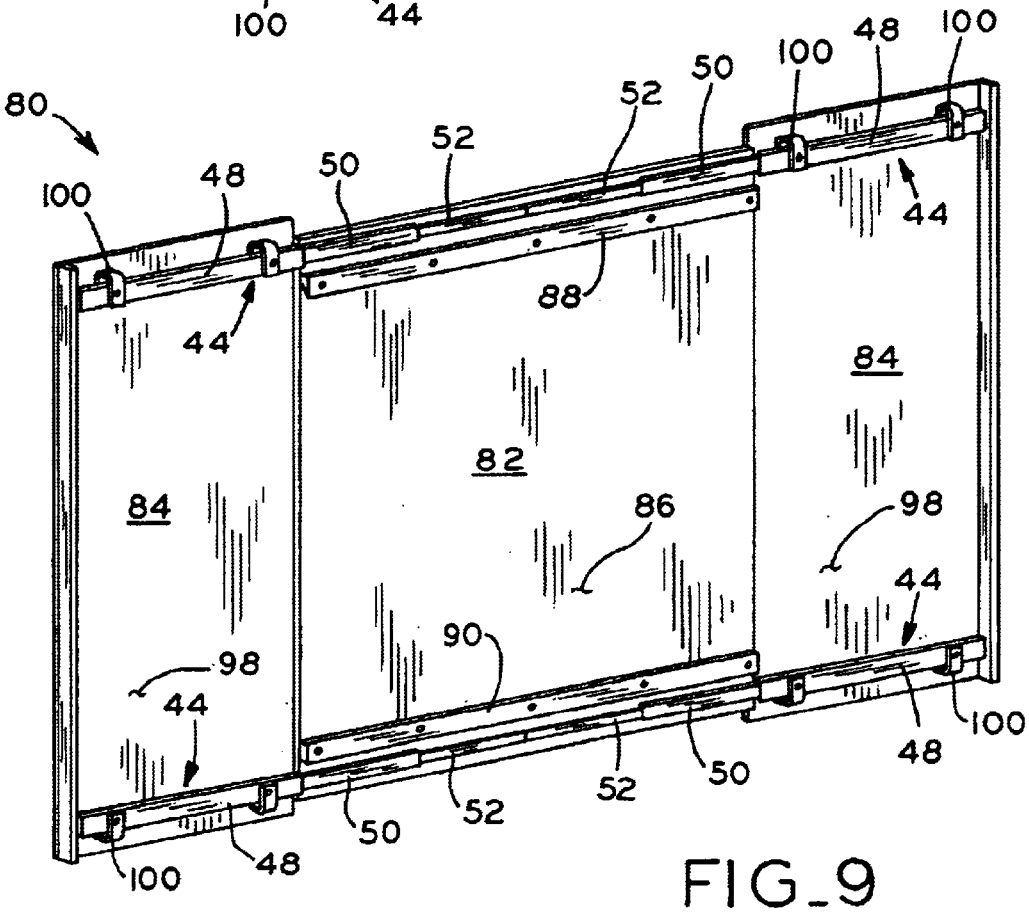
FIG. 9 is a rear perspective view of the display board of FIG. 7, showing the covers in a fully extended or open position.
Figure 10:
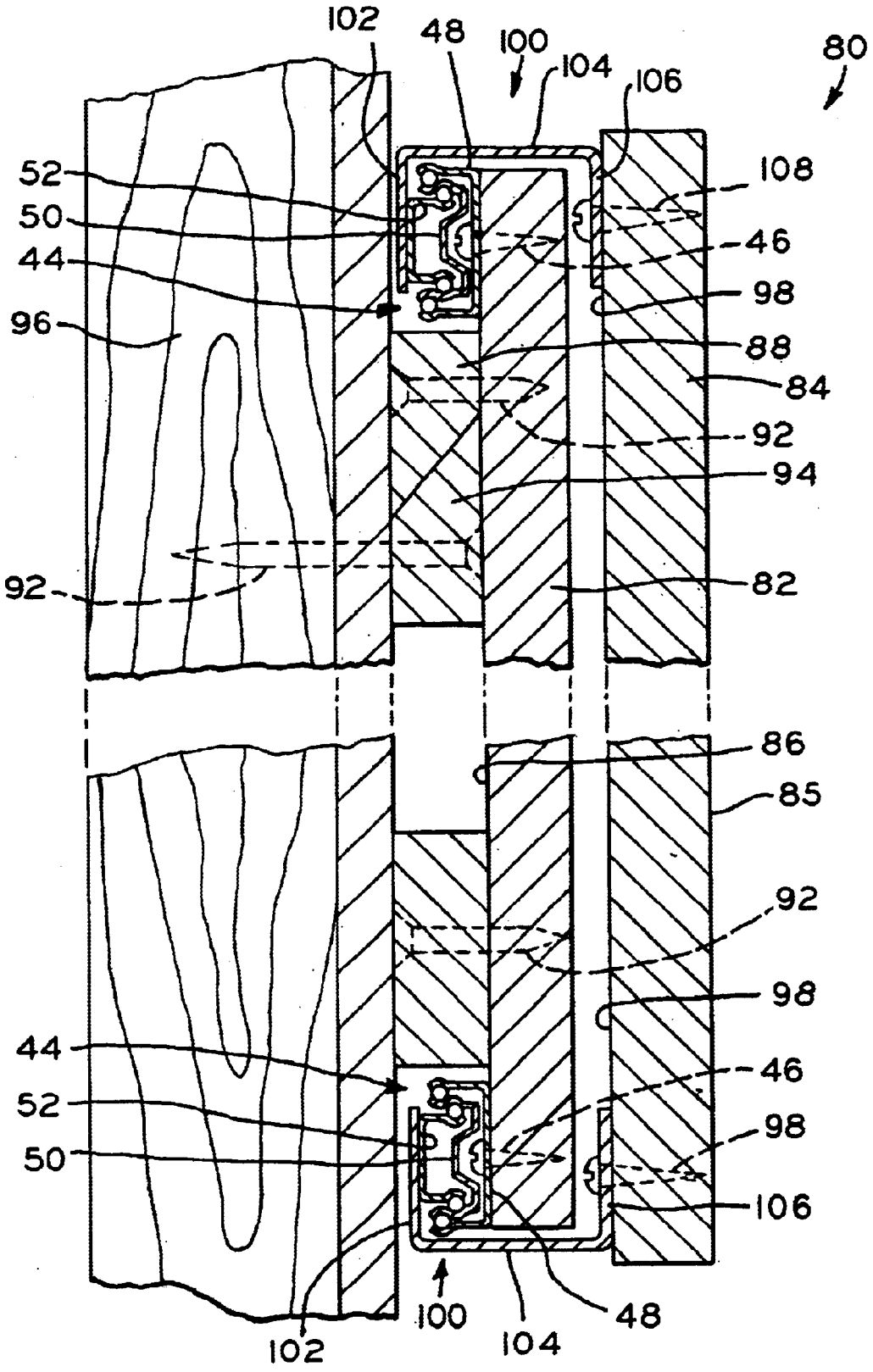
FIG. 10 is a sectional view taken along line 10—10 of FIG. 6.

In FIGS. 6 and 8, display board 80 shown in a closed position with covers 84 covering main panel 82, and in FIGS. 7 and 9, display board 80 is shown in an open position with covers 84 moved outwardly to expose main panel 82. Referring to FIGS. 8–10, main panel 82 includes rear surface 86 having wedge block 88 and support block 90 mounted thereto by suitable fasteners 92. As shown in FIG. 10, wedge block 88 of display panel 80 is adapted to cooperate with a complimentary wedge block 94 secured to the surface of an existing wall 96 by a suitable fastener 92 in order to hang display board 80 from wall 96, wherein support block 90 also abuts wall 96 to support the bottom portion of display panel 80 against wall 96.

Still referring to FIG. 10, slide mechanisms 44 are mounted with suitable fasteners 46 to rear surface 86 of main panel 82. Alternatively, slide mechanisms 44 may be mounted to another component, such as a header or a support panel (not shown), for example, which in turn is mounted to rear surface 86 of main panel. Slide mechanisms 44 are similar or identical to those described above with respect to cabinet 20. A generally U-shaped bracket 100 includes first portion 102 secured to inner slide member 52 of slide mechanism 44 in a suitable manner, such as by fasteners or by welding, for example. Bracket 100 further includes intermediate portion 104, and second portion 106 secured to rear surface 98 of cover 84 by suitable fasteners 108. Referring to FIGS. 6–9, display board 80 is shown including upper and lower slide mechanisms 44 for each cover 84, and each slide mechanism 44 is shown connected to each cover 84 by two brackets 100. In alternative embodiments, however, the number of slide mechanisms 44 used to mount each cover 84 to main panel 82 may be varied, as may the number of brackets 100 used to connect slide mechanisms 44 to covers 84.

Referring to FIGS. 6 and 8, covers 84 are shown in a closed position with the adjacent edges of covers 84 abutting or closely disposed to one another. Front surface 85 of covers may include a functional surface, such as a marker board, chalk board, tack board, or a projection screen, for example. Covers 84 may each include ledge 110 for supporting articles such as writing instruments or picture displays. Additionally, each cover 184 may also include tack strip 112 for tacking materials thereto, and further may include pegs 114 for attachment of accessories such as flip chart 116.

Referring to FIGS. 7 and 9, covers 84 may slide laterally outwardly of main panel 82 via extension of slide mechanisms 44. As shown, because slide mechanisms 44 are mounted to rear surface 86 of main panel 82, slide mechanisms 44 are hidden from view when covers 84 are in a closed position or an open position. Referring to FIG. 7, front surface 118 of main panel 82, similar to front surface 85 of covers 84, may include any suitable functional surface, such as a marker board, chalk board, tack board, or a projection screen, for example.

Figure 11:
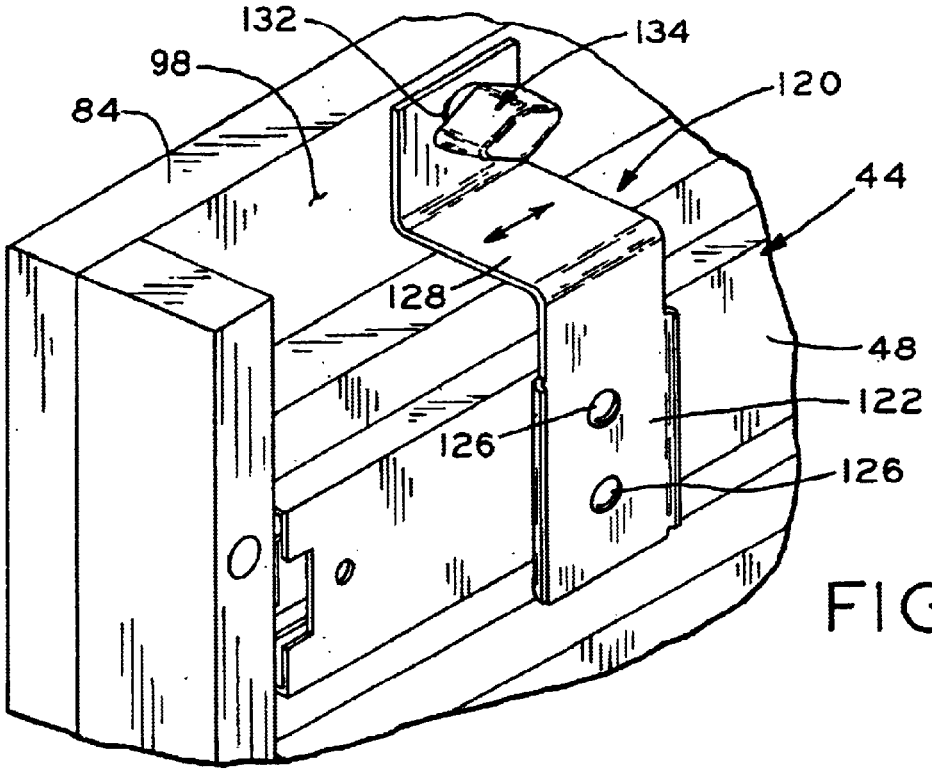
FIG. 11 is a partial rear perspective view of a display board, showing a modified mounting arrangement of a cover to a slide mechanism.
Figure 12:
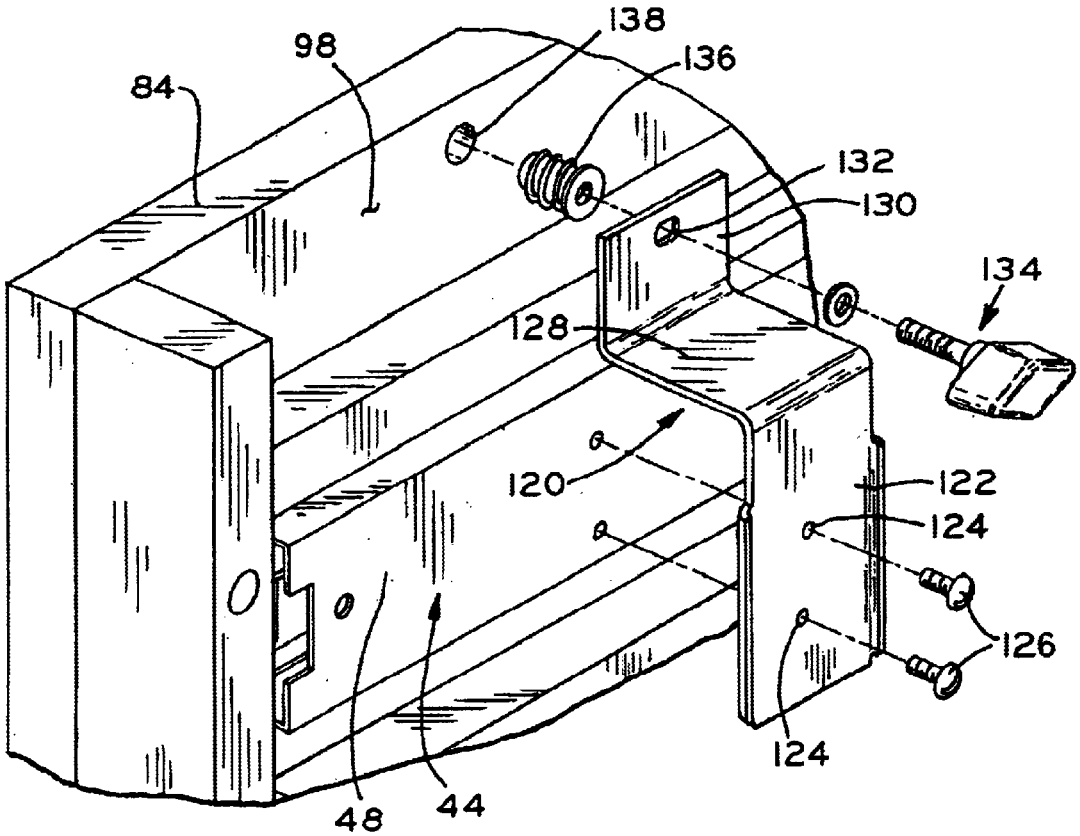
FIG. 12 is an exploded view of FIG. 11.

Referring to FIGS. 11 and 12, a modified arrangement for connecting covers 84 to slide mechanisms 44 is shown, including a substantially Z-shaped bracket 120. First portion 122 of bracket 120 includes apertures 124 through which fasteners 126 are disposed to secure bracket 120 to outer slide member 48 of slide mechanism 44. Alternatively, bracket 120 may be secured to outer slide member 48 in another manner, such as by welding. Bracket 120 also includes intermediate portion 128, and second portion 130 having an aperture 132 through which a threaded fastener 134, such as a thumbscrew, is disposed. To secure second portion 130 of bracket 120 to cover 84, fastener 134 is threaded into anchor 136, which in turn is secured in hole 138 in rear surface 98 of cover 84. Aperture 132 in second portion 130 of bracket 120 is sized larger than the diameter of fastener 134 such that the position of cover 84 is slightly adjustable relative to bracket 120.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A display board, comprising:

a first panel having a rear surface and a front surface;

a slide mechanism connected to said rear surface of said first panel;

a second panel disposed in front of said front surface of said first panel; and a bracket connecting said slide mechanism and said second panel, wherein said second panel is slidable relative to said first panel to selectively cover and expose said front surface of said first panel, wherein said rear surface of said first panel includes mounting structure for mounting said display board to a wall.

2. The display board of claim 1, wherein said slide mechanism is disposed substantially horizontally, and said second panel is slidable laterally with respect to said first panel.

3. The display board of claim 1, wherein said display board includes at least two slide mechanisms and associated brackets, and at least two said second panels slidably mounted to said first panel, said second panels slidable laterally outwardly of said first panel in opposite directions with respect to one another.

4. The display board of claim 1, wherein said bracket includes an aperture through which a threaded fastener is disposed to connect said bracket to said second panel, said aperture larger than a diameter of said threaded fastener such that the position of said bracket relative to said second panel is adjustable.

5. The display board of claim 1, wherein said bracket has one of a Z-shaped profile and a U-shaped profile.

6. The display board of claim 1, wherein said slide mechanism includes outer, inner, and intermediate slide members, said intermediate and inner slide members slidable telescopingly outward of said outer slide member.

7. A display board, comprising:

a first panel having a rear surface and a front surface;

a slide mechanism connected to said rear surface of said first panel;

a second panel disposed in front of said front surface of said first panel; and a bracket connecting said slide mechanism and said second panel, wherein said second panel is slidable relative to said first panel to selectively cover and expose said front surface of said first panel, wherein said front surface of said first panel is selected from the group consisting of a markerboard, a chalkboard, a tackboard, and a projection screen.

8. The display board of claim 7, wherein said slide mechanism is disposed substantially horizontally, and said second panel is slidable laterally with respect to said first panel.

9. The display board of claim 7, wherein said display board includes at least two slide mechanisms and associated brackets, and at least two said second panels slidably mounted to said first panel, said second panels slidable laterally outwardly of said first panel in opposite directions with respect to one another.

10. The display board of claim 7, wherein said bracket includes an aperture through which a threaded fastener is disposed to connect said bracket to said second panel, said aperture larger than a diameter of said threaded fastener such that the position of said bracket relative to said second panel is adjustable.

11. The display board of claim 7, wherein said bracket has one of a Z-shaped profile and a U-shaped profile.

12. The display board of claim 7, wherein said slide mechanism includes outer, inner, and intermediate slide members, said intermediate and inner slide members slidable telescopingly outward of said outer slide member.

* * * * *